US007845173B2

(12) United States Patent
Oser et al.

(10) Patent No.: US 7,845,173 B2
(45) Date of Patent: Dec. 7, 2010

(54) METHOD AND INSTALLATION FOR CONVERTING THERMAL ENERGY FROM FLUIDS INTO MECHANICAL ENERGY

(75) Inventors: Erwin Oser, Cologne (DE); Michael Rannow, Lennestadt (DE)

(73) Assignee: Ecoenergy Patent GmbH, Darmstadt (DE)

( * ) Notice: Subject to any disclaimer, the term of this patent is extended or adjusted under 35 U.S.C. 154(b) by 725 days.

(21) Appl. No.: 10/589,409

(22) PCT Filed: Feb. 10, 2005 (Under 37 CFR 1.47)

(86) PCT No.: PCT/EP2005/050595

§ 371 (c)(1), (2), (4) Date: Sep. 19, 2007

(87) PCT Pub. No.: WO2005/078243

PCT Pub. Date: Aug. 25, 2005

(65) Prior Publication Data

US 2009/0205337 A1 Aug. 20, 2009

(30) Foreign Application Priority Data

Feb. 12, 2004 (DE) ..... 10 2004 006 837

(51) Int. Cl.
*F01K 25/06* (2006.01)

(52) U.S. Cl. ..... 60/649; 60/651; 60/671

(58) Field of Classification Search ..... 60/649, 60/651, 671
See application file for complete search history.

(56) References Cited

U.S. PATENT DOCUMENTS

| | | | | |
|---|---|---|---|---|
| 3,505,810 | A | 4/1970 | Mamiya | |
| 4,398,392 | A * | 8/1983 | Ganic | 60/657 |
| 6,594,997 | B2 * | 7/2003 | Romanelli | 60/651 |

FOREIGN PATENT DOCUMENTS

| | | |
|---|---|---|
| DE | 102 14 183 | 5/2003 |
| DE | 102 44 385 | 4/2004 |
| FR | 1.546.326 | 12/1967 |
| JP | 06200710 | 12/1992 |

* cited by examiner

*Primary Examiner*—Hoang M Nguyen
(74) *Attorney, Agent, or Firm*—Cohen Pontani Lieberman & Pavane LLP

(57) ABSTRACT

A method and a system for converting heat energy contained in fluids as noticeable or latent heat to mechanical energy, wherein a working fluid is evaporated by means of the heat energy, if necessary after transformation to a higher temperature level, by means of one or more series-connected heat pumps and expanded in an expansion device, and wherein the heat energy is at least partially converted to mechanical energy. The expansion occurs in a low-pressure expansion device and the energy contained in the expanded evaporated working fluid is recyclable into the evaporating device in an evaporating unit, which is usable for evaporating additional working fluid.

28 Claims, 1 Drawing Sheet

METHOD AND INSTALLATION FOR CONVERTING THERMAL ENERGY FROM FLUIDS INTO MECHANICAL ENERGY

CROSS REFERENCE TO RELATED APPLICATIONS

This is a U.S. national stage of application No. PCT/EP2005/050595, filed on 10 Feb. 2005. Priority is claimed on the following application(s): Country: Germany, Application No.: 10 2004 006 837.2, Filed: 12 Feb. 2004; the content of which is incorporated here by reference.

BACKGROUND OF THE INVENTION

The present invention relates to a method of transforming heat energy contained in fluids, for example, as noticeable or latent heat, into mechanical energy, wherein a working fluid is evaporated in an evaporator and expanded in an expansion device, whereby heat energy is transformed at least partially into mechanical energy. The present invention also relates to a system for transforming heat energy from fluids into mechanical energy.

A great number of devices and methods for obtaining mechanical energy are known from the state of the art. For example, heat engines are known, in which a working fluid, such as water vapor is isobarically heated at a high pressure up to the boiling point in a boiler, evaporated and then superheated in a superheater. Subsequently the vapor is adiabatically expanded in a turbine, where it does work, and condensed in a condenser, where it gives off heat. The liquid is pressurized by a feed-water pump and fed back into the boiler. One of the drawbacks of this device is that during the expansion process in turbines high pressures of more than 15 to 200 bar have to be generated since in turbines the pressure ratio of the expansion is essential to achieve economic efficiency.

Another feature of the prior art expansion processes for converting heat energy to mechanical energy is that the condensation waste heat generated in the condensation of the working fluid is disadvantageous waste heat for the expansion process itself, which negatively affects efficiency.

SUMMARY OF THE INVENTION

It is therefore an object of the present invention to provide a method and an apparatus for converting heat energy to mechanical energy while avoiding the above drawbacks, and improved efficiency, in particular with temperature and pressure levels, which approach, for example, the natural environmental conditions.

According to the present invention a method of converting heat energy from a fluid into mechanical energy by means of expansion of an evaporated working fluid in an expansion device connected to an evaporator is provided, wherein heat energy evaporates a working fluid by means of heat exchange in an evaporator and/or heat energy is transformed to a higher temperature level by means of at least one or more series-connected heat pumps, in order to evaporate the working fluid in the evaporator by means of heat exchange, wherein the evaporated working fluid is an evaporated mixture of at least two components, and is expanded in a low-pressure expansion device, wherein the energy set free by the working fluid is partially converted to mechanical energy, and wherein at least one second evaporated component has its temperature increased downstream of the low-pressure expansion and energy is withdrawn from at least one first component of the working fluid so that the energy contained in the expanded, evaporated, temperature-increased second component of the working fluid is recyclable into the evaporator and usable for evaporating additional working fluid.

Heat energy for evaporating a working fluid by means of heat exchange in an evaporator can be provided, for example, by at least one energy source which is highly efficient. An energy source with high efficiency can be selected, for example, from the group comprising heat pumps, fuel cells and/or solar energy systems.

Solar energy systems in the context of the present invention could also comprise solar collectors.

At least part of the necessary energy, preferably all of the energy, required for increasing the temperature of the second component downstream of the low-pressure expansion can be generated by the energy set free in an absorption and/or adsorption process.

The terms "absorption" and "absorbed" in the context of the present invention have the meaning of "absorption and/or adsorption" or "absorbed and/or adsorbed", respectively.

The term "expansion" in the context of the present invention means an increase in volume accompanied by a pressure reduction.

According to the present invention it can also be provided that a working fluid is evaporated with the heat energy present in a fluid in the form of noticeable or latent heat of one or more components, if required after a transformation to a higher temperature level by means of one or more series-connected heat pumps in an evaporator, that the expansion is carried out in a low-pressure expansion device and that the energy contained in the expanded evaporated working fluid is recyclable into the evaporator, where it is useable for evaporating additional working fluid. Preferably the method comprises a first component of the working fluid formed as a mixture and absorbed in and/or downstream of the low-pressure expansion device by means of an absorption fluid, wherein heat is transferred to the second component remaining evaporated.

The interposed heat pump process for transforming the temperature level of the working fluid to be expanded can be realized with different forms of heat pumps as will be described below.

It can be additionally provided, depending on the magnitude of the desired temperature increase, to carry out the energy transformation for temperature increase also with a plurality of series-connected heat pump processes.

According to the present invention, the expansion of the working fluid in a low-pressure expansion device, wherein the energy contained in the expanded evaporated working fluid is recyclable into the evaporator and useable for evaporating additional working fluid. For this purpose the working fluid to be expanded is formed as a mixture and the method preferably comprises at least one first component of the working fluid which is absorbed by means of an absorption fluid in and/or downstream of the low-pressure expansion device and/or is adsorbed by means of an adsorption fluid, wherein heat energy is transferred to the remaining, evaporated second component, which is recyclable.

The working fluid is preferably present as an isotropic mixture or as a mixture with a reduced boiling point, with reference to the boiling point of the component having the highest boiling point, wherein working fluids in the form of mixtures are preferred which have their boiling point reduced by at least 5° C., preferably at least 10° C., more preferably at least 15° C., even further preferably at least 20° C., and most preferably at least 25° C., with respect of the boiling point of the component having the highest boiling point.

In one embodiment of the invention the working fluid mixture is isotropic at a certain mixing ratio of the components and has a minimum boiling point. With azeotropically evaporating mixtures with a minimum boiling point, the evaporating temperatures can be lowered, so that they are below the condensation temperatures of the individual components. If the first component is adiabatically absorbed from the vapor mixture, the corresponding heat is transferred to the second component remaining evaporated. The extraction of condensation heat can therefore be carried out at an increased temperature level. In particular, with suitably selected isotropic mixtures, the second evaporated component can be condensed in the evaporator of the working fluid itself while giving off the condensation heat, so that the corresponding proportion of heat energy can be recycled into the process.

According to the present invention, suitable applicable isotropic mixtures can be selected from the group comprising pyridine/water, water/ethanol, water/ethyl acetate, water/dioxane, water/tetrachloromethane, water/benzene, water/toluene, ethanol/ethyl acetate, ethanol/benzene, ethanol/chloroform, ethanol/tetrachloromethane, ethyl acetate/tetrachloromethane, methanol/tetrachloromethane, methanol/benzene, chloroform/acetone, toluene/acetic acid, acetone/carbon disulfide and/or water/silicone.

Similarly suitable isotropic mixtures applicable according to the present invention can also be multi-component systems, i.e. these isotropic mixtures comprise at least three components or at least four components. Basically all isotropic mixtures known from the literature, which are incorporated in their entirety by reference, are applicable in so far as they are suitable for the present invention.

It is preferred, if the first component to be absorbed is water, that an alkaline silicate solution can be used, for example, as the absorption fluid.

The use of water is advantageous since the condensation heat of water, i.e. from gaseous to liquid, is particularly high. The heat energy set free hereby can be advantageously used for heating the second component.

Absorption fluids and/or adsorption fluids suitable to be used for the present invention can be selected from the group comprising zeolites, silicates, inorganic acids, in particular phosphoric acid, halogen acids, sulfuric acid, silicic acid, organic acids, inorganic salts and/or organic salts.

Suitable salts are alkaline salts and/or alkaline earth salts, in particular their halogen salts, such as LiBr, LiCl, $MgCl_2$ and the like.

As absorption fluids and/or adsorption fluids basically all substances are suitable which absorb and/or adsorb a solvent of the working fluid. However, absorption fluids and/or adsorption fluids are preferred which set free the absorbed and/or adsorbed component of the working fluid only with little energy input.

It could also be advantageous if the absorption fluid/adsorption fluid, after taking in a first component of the working fluid, could be easily separated from the second component of the working fluid.

The absorption/adsorption fluid for taking in at least one first component of the working fluid can be advantageously selected such that the overall efficiency of the system according to the present invention for converting heat energy from fluids into mechanical energy with a starting fluid temperature of 25° C. measured over 24 hours including the energy needed for separating the first component from the absorption fluid/adsorption fluid remains higher than 40%.

The working fluid for low-pressure expansion, such as an isotropic mixture of water and perchloroethylene, can be evaporated, for example, by means of a heat exchange with primary energy of process vapors or heated process fluids and/or heat stores. The absorption in which, according to the present invention, the created absorption heat is transferred to the second component remaining evaporated, wherein this second component is heated to a temperature level above the boiling temperature of the isotropic mixture, can occur in and/or downstream of the expansion device. One of the essential advantages herein is that by expanding the isotropic mixture, heat energy can be transferred into mechanical energy and, with the help of a generator, into electrical energy and, at the same time, the expanded working fluid which has already "done work" in the expansion process is heated due to the separation (absorption) of the first from the second component due to the absorption heat set free. Herein the remaining working fluid can be recycled after expansion to give off heat in a heat exchanger, for example. In one embodiment of the present invention it is possible, for example, that the remaining working fluid (second component only) is fed to a heat exchanger (evaporator), in which the remaining working fluid is condensed and the liquid working fluid is evaporated together with the first and the second component due to the condensation heat generated and subsequently recycled into the expansion device. This is how according to the present invention the efficiency of the method for converting heat energy into mechanical energy can be substantially improved.

The working fluid for low-pressure expansion is preferably formed by an isotropic mixture with a minimum boiling point, or by a nearly isotropic mixture. In the following the present invention will be described with reference to an isotropic mixture, while the present invention can, of course, also relate to nearly isotropic mixtures or non-isotropic mixtures. High efficiencies can be achieved in particular with an isotropic or near isotropic mixture. Depending on the type of isotropic mixture used, evaporation temperatures can be lowered, so that they are below the evaporation temperatures of the individual components.

In a preferred embodiment the working fluid has a low volume-specific or low molar evaporation enthalpy. It is thus possible to achieve the generation of a great amount of drive vapor with a given amount of heat energy.

At least one component of the working fluid, preferably the second component, can preferably have a boiling point according to the present invention in the range of between 20° C. and 250° C., preferably between 40° C. and 200° C., preferably of between 60° C. and 150° C., more preferably of between 80° C., and 120° C., and most preferably of between 90° C. and 100° C.

At least one component of the working fluid, preferably the second component, can preferably have a molar evaporation heat according to the present invention in the range of between 5 kJ/mol and 15 kJ/mol, preferably of between 6 kJ/mol and 14 kJ/mol, preferably of between 7 kJ/mol and 13 kJ/mol, more preferably of between 8 kJ/mol and 12 kJ/mol, and most preferably of between 9 kJ/mol and 10 kJ/mol.

At least one component of the working fluid, preferably the second component, preferably according to the present invention can have a low specific heat capacity [cp] of less than 1.2 J/g, preferably of between 0.4 J/g and 1 J/g, preferably of between 0.5 J/g and 0.9 J/g, and most preferably of between 0.6 J/g and 0.8 J/g.

Preferably the working fluid is a solvent mixture comprising organic and/or inorganic solvent components. Examples can be mixtures of water and silicone(s).

Preferred silicones and/or derivatives thereof can have a boiling point according to the present invention in the range of between 20° C. and 250° C., preferably of between 40° C. and 200° C., preferably of between 60° C. and 150° C., more preferably of between 80° C. and 120° C., and most preferably of between 90° C. and 100° C.

Silicones and/or derivatives thereof to be preferably used in the context of the present invention can have a molar evaporating heat in the range of between 5 kJ/mol and 15 kJ/mol, preferably of between 6 kJ/mol and 14 kJ/mol, preferably of between 7 kJ/mol and 13 kJ/mol, more preferably of between 8 kJ/mol and 12 kJ/mol, and most preferably of between 9 kJ/mol and 10 kJ/mol.

Silicones and/or derivatives thereof to be preferably used according to the present invention can have a low specific heat capacity [cp] of less than 1.2 J/g, preferably of between 0.4 J/g and 1 J/g, preferably of between 0.5 J/g and 0.9 J/g, and most preferably of between 0.6 J/g and 0.8 J/g.

The working fluid can be a mixture of water and at least one or more silicones. Preferably a mixing ratio of water to silicone(s) is between 1:100 and 1:2, more preferably 1:50, even more preferably 1:25, more preferably 1:15, and most preferably between 1:8 and 1:10.

Advantageously at least one component can be a protic solvent.

In an alternative embodiment the absorption fluid is a reversibly immobilizable solvent which, in the non-immobilized aggregate state, is the first component of the working fluid. The reversible solvent in the boiling working fluid can change advantageously by means of physicochemical changes in such a way that it can be changed from the non-immobilized state to the reversibly immobilized state by ionizing or complex formation from the vapor phase, and can act as an absorption fluid for the working fluid in the non-immobilized form. This is how the evaporated working fluid already contains the absorption fluid (in the non-immobilized state) prior to expansion. The reversibly immobilized solvent is in an evaporated aggregate state and assumes the liquid state by physicochemical changes, such as pH shift, change of mole fraction and the temperature in its volatility and/or in its vapor pressure (which can be compared to steam as a solvent in its non-immobilized form and water as a reversibly immobilizable solvent). This is advantageous in that the working fluid consists of two components, wherein the one component in the reversibly immobilized state acts at the same time as an absorption fluid for the other component. Cyclic nitrogen compounds, such as pyridines, can be used, for example, as pH-dependent reversibly immobilizable solvents.

The absorption of the first component can occur, for example, already in the low-pressure expansion device. It is of course also possible that an absorption device, for example formed as a scrubber, is downstream of the low-pressure expansion device. In one possible embodiment the ionization of the reversibly immobilizable solvent can be carried out by means of electrolysis or by the addition of an electrolyte in the absorption device causing the solvent to arise in its immobilized form as an absorption fluid from the working fluid. Simultaneously the vapors of the working fluid passing through the absorption fluid are also ionized so that the vapor pressure is sufficiently lowered for the vapor of the reversibly immobilizable component in the working fluid to precipitate. The isotropic working fluid is therefore passed through the absorption fluid which takes up (absorbs) the first component, wherein the freed absorption energy is transferred to the evaporated remaining second component. Subsequently the absorption fluid can be recycled into the evaporator where it is transferred into a non-ionized state, for example, by means of deionization and is re-evaporated with the condensed phase of the remaining second component as an isotropic mixture.

As absorption systems in the context of the present invention, apart from the usual scrubber systems, such as Venturi scrubbers, also compressors or pumps can be used, which have a sufficient amount of operating liquid, for example roots blowers with injection, screw compressors, fluid-ring pumps or liquid jet pumps. By combining the process with a polytropic compressor system the temperatures of certain mixtures can be adapted to the purpose in question.

Suitably the mole ratio of the working fluid is chosen such that the pressure in the expansion due to the reduction of the number of molecules remaining in the gaseous phase is reduced more than the pressure is increased due to the heating of the remaining gas, so that a build-up of an otherwise resulting counter-pressure downstream of the expansion device is avoided.

The low-pressure expansion device can be an apparatus in which neither the mass of the vapor nor the pressure ratio but solely the pressure differential is relevant.

In a particularly preferable embodiment, the low-pressure expansion device is a roots blower (roots pump/roots rotary positive blower), as a roots blower or in the form of a lobed impeller pump. It is advantageous that the roots blower can work as an expansion device (expansion motor) with a pressure differential of as little as 500 mbar at its full efficiency, and can be used with pressures between 10 and 0.5 bar in a closed system. According to the invention the roots blower can be formed with at least one injection opening through which the absorption fluid and/or a protic solvent can be introduced into the roots blower. Advantageously the injection is pressure-controlled to avoid fluid damage. Another advantage is that in the above expansion devices, only the pressure differential is critical for the efficiency rather than the mass or the expansion ratio.

Suitably, the roots blower has a gas-tight gasket between the suction chamber and the drive chamber wherein, in a further embodiment, the roots blower has multi-blade rotors.

The roots blower also has a shaft which can be coupled to a generator such that the mechanical energy can be converted to electric energy. The use of a roots blower as a low-pressure expansion device makes it possible, in particular when using waste heat at a temperature of less than about 100° C. for driving pumps or generators, for example, to support on the one hand the process by injecting absorption fluids and on the other to use the energy remaining in the expanded evaporated working fluid, as described above, to achieve a higher temperature level and therefore to make it recyclable.

According to the present invention it can be provided that the roots blower expands rather than compresses a pressurized working fluid.

In another embodiment of the present invention, a separating assembly can be provided for separating the absorbed first component from the absorption fluid. The separating assembly can be formed as a membrane system, for example, which is downstream of the absorption device. The desorbed liquid first component is suitably recycled into the evaporator, in which it is evaporated with the second liquid component together as an isotropic working fluid. The absorption fluid can be fed to the expansion device, for example, in which it is injected into the expanding working fluid. In a further alternative the absorption fluid can be recycled into the scrubber, in which the absorption of the first component from the working fluid is carried out. Absorption fluids can be oils from which the first component of the working fluid can be completely extracted, such as by means of a membrane system.

The separation of the first absorbed component in the absorption fluid can be carried out alternatively by means of an evaporation process of the absorbed component.

Preferably the second component remaining downstream of the absorption device, which has taken up heat due to the absorption despite the expansion, is fed into a heat exchanger and condensed. The heat exchanger is preferably an evaporator in which the first and second components are evaporated as working fluids.

Preferably the working fluid is an isotropic mixture of water and silicone. The water herein is the first, absorbing component and silicone the second component. Suitably the absorption fluid is a silicate. Advantageously the absorption fluid is an alkaline molecularly disperse silicate solution, wherein the water absorbed in the alkaline silicate solution is desorbed, for example, by heating.

The object of the present invention is also met by a system for converting heat energy to mechanical energy is provided comprising the following components:

a) an evaporation unit in which a working fluid formed as a mixture can be evaporated,
b) a low-pressure expansion device,
c) an absorption apparatus and/or an adsorption apparatus integrated with the low-pressure expansion device and/or downstream of the low-pressure expansion device,
d) a separating apparatus which can be formed as a membrane system or a thermal generator in which the absorbed component is separated from the absorption fluid, and a pump for feeding the absorption fluid to the separating device and back to the absorption apparatus,
e) at least one energy source in contact with the evaporating unit, by means of which heat energy can be generated which is taken up by a fluid stream in the evaporator to transform the fluid stream to a higher temperature level.

The at least one energy source can be a heat pump, a fuel cell and/or a solar energy system. Preferably the use of at least one heat pump is contemplated due to its advantageous energy balance. Heat pumps can be advantageously used at low environmental temperatures. Solar energy systems require sufficiently high solar radiation so that in cooler regions it may be preferable to use heat pumps. Fuel cells can also be used due to their high efficiency.

It can be preferable to use fuel cells in combination with solar energy systems and/or heat pumps. Generally it may be advantageous to use various energy sources to optimize the efficiency of the system of the present invention depending on environmental conditions.

The present invention relates to a system-having an evaporator in which a working fluid formed by a mixture, preferably an isotropic mixture, can be evaporated, a low-pressure expansion device with an absorption apparatus integrated with a low-pressure expansion device and/or downstream of the low-pressure expansion device, wherein, in the absorption apparatus, a first component of the working fluid can be absorbed by an absorption fluid and heat can be transferred to the remaining evaporated second component, which is recyclable.

In the embodiment in which initially a first working fluid is evaporated with the heat energy of the fluid, the working fluid subsequently being transformed to a higher temperature level by means of a heat pump, so that a "second" working fluid is evaporated for low-pressure expansion which is subsequently expanded in a low-pressure expansion device, wherein the heat energy is partially converted to mechanical energy, the present invention relates to a system additionally comprising one or more heat pumps in various embodiments.

In a first embodiment of such a heat pump it is provided that on the one hand the temperature increase of the working fluid occurs by mechanical compression and on the other the temperature of the working fluid is additionally increased in the compressor by means of heat exchange with an operating fluid which is in direct contact with the working fluid and/or on the other hand additionally by means of an operating fluid which acts as an absorption fluid, wherein the absorption fluid absorbs a first component of the working fluid, which is formed by a mixture, in and/or downstream of the compressor, wherein heat is transferred to the remaining evaporated second component. The efficiency, in particular for heat pumps, can be significantly improved by the method according to the present invention.

On the one hand, the temperature increase of the working fluid is due to the compression of the working fluid. On the other hand there is the possibility to realize the temperature increase by means of a heat exchange with the operating fluid. Herein the compressor is preferably formed as a liquid sealed compressor. This can be, for example, a fluid-ring pump or a liquid sealed screw compressor. It is particularly advantageous that these liquid sealed compressors can be operated with operating fluids having high boiling points. Since in liquid sealed compressors the operating fluid has no lubricating function but only a sealing function, any working fluid, even including water, can be used in the method according to the present invention, which have high molar evaporating heats, have large temperature jumps in the low-temperature range, and allow high operating temperatures of the compressor.

Another process-related advantage according to the present invention of separating compression and heating in the fluid-ring pump lies in the possibility to realize temperatures of the working fluid, after increasing the temperature, of above 180° C. Operating fluids, such as silicone oils or Diester oils or plasticizers, such as dioctylphthalate having viscosities of up to 50 centistokes (cts), are particularly advantageous. Advantageously the boiling point of the operating fluid is higher than the temperature of the working fluid after increasing the temperature.

It is also possible that the working fluid of the heat pump is a one-component solvent, such as water or a solvent with a high boiling point.

Preferably a separating assembly is downstream of the compressor. Where a liquid sealed compressor is used there is a possibility that small amounts of operating fluid of the compressor are enriched in the evaporated working fluid. The separating assembly is for extracting these percentages and for recycling them into the compressor. In another embodiment of the present invention an aerosol separator can be downstream of the separating assembly for extracting minute particles (droplets) of the operating fluid from the evaporated working fluid, which can also be fed to the compressor. If oil residue has collected, it can be fed back into the compressor according to another embodiment of the present invention.

Suitably a condenser is downstream of the separating assembly and/or the aerosol separator, wherein any condensate of the working fluid can be fed to the evaporator. In the condensator the working fluid is condensed under an increased pressure generated by the compressor, wherein the working fluid can give off heat at a high temperature level. The condensate generated is preferably recycled to the evaporator via an expansion valve.

The temperature increase of the evaporated working fluid can be realized according to the present invention not only by mechanical compression, but also by absorbing one component of the working fluid, which in this case is a mixture of at least two components, in an absorption fluid, wherein the absorption heat set free is transferred to the second component remaining evaporated. The absorption systems used for this, apart from the usual scrubber systems, such as Venturi scrubbers, can also be compressor systems having a sufficient amount of operating liquid such as the above mentioned fluid-ring pumps already explained in their operation.

A particularly advantageous embodiment of the present invention provides for the heat pump process the use of isotropic mixtures as working fluids, wherein the operating fluid of the compressor acts as an absorption fluid for one component of the working fluid. This means that the mixture is isotropic in its behavior. If during the passage of the evaporated working fluid during compression one component is extracted, heat generated due to its phase transition is transferred to the component remaining evaporated causing an additional temperature increase of the working fluid. In one embodiment of the present invention the mixture is isotropic at a certain mixing ratio of the components with a minimum boiling point. With azeotropically evaporating mixtures with a minimum boiling point the evaporation temperatures can be lowered depending on each type, so that they are below the condensation temperatures of the individual components. If the first component is adiabatically absorbed from the vapor mixture, the corresponding heat is transferred to the second component remaining evaporated. The extraction of the condensation heat can therefore occur at a higher temperature level.

The working fluid, such as an isotropic mixture of water and perchloroethylene or silicones, can be evaporated, for example, due to a heat exchange with the fluid from process vapors or heated process fluids and/or heat stores or any other fluids. The absorption, during which according to the present invention the absorption heat generated is transferred to the second component remaining evaporated causing this component to be heated to a temperature level above the boiling point of the isotropic mixture, can be in and/or downstream of the compressor. One of the essential advantages hereof is that the compressed working fluid is additionally heated due to the separation (absorption) of the first from the second component due to the absorption heat generated.

The working fluid is preferably formed by an isotropic mixture with a minimum boiling point or by a nearly isotropic mixture. In the following the present invention will be described with reference to an isotropic mixture, although the present invention can, of course, also relate to nearly isotropic mixtures or non-isotropic mixtures. High efficiencies can be achieved in particular with an isotropic or near isotropic mixture. Depending on the type of isotropic mixture used, evaporation temperatures can be lowered, so that they are below the evaporation temperatures of the individual components.

Preferably the working fluid is a solvent mixture containing organic and/or inorganic solvent components. These can be, for example, mixtures of water and selected silicones. Preferably at least one component may be a protic solvent.

In an alternative embodiment the absorption fluid is a reversibly immobilizable solvent which, in the non-immobilized aggregate state, is the first component of the working fluid. The reversible solvent in the boiling working fluid can change advantageously by means of physicochemical changes in such a way that it can be changed from the non-immobilized state to the reversibly immobilized state by ionizing or complex formation from the vapor phase, and can act as an absorption fluid for the working fluid in the non-immobilized form. This is how the evaporated working fluid already contains the absorption fluid (in the non-immobilized state) prior to expansion. The reversibly immobilized solvent is in an evaporated aggregate state and assumes the liquid state by physicochemical changes, such as pH shift, change of mole fraction and the temperature in its volatility and/or in its vapor pressure (which can be compared to vapor as a solvent in its non-immobilized form and water as a reversibly immobilizable solvent). This is advantageous in that the working fluid consists of two components, wherein the one component in the reversibly immobilized state acts at the same time as an absorption fluid for the other component. Cyclic nitrogen compounds, such as pyridines, can be used, for example, as pH-dependent reversibly immobilizable solvents.

Preferably an electrochemical change can be achieved by the above electrolysis of one of the components or by means of an added electrolyte. In the uncharged or non-dissociated state the reversibly immobilizable solvent will azeotropically behave as a solvent mixture with the second component and evaporate according to the adjusted pressure and temperature levels. If however, the reversibly immobilizable solvent in its ionized or dissociated form is used as a scrubbing fluid, it can be taken up in any amount and recycled into the evaporator, where it is incorporated in the evaporation process in its deionized or undissociated form.

Absorption systems, apart from the usual scrubber systems, such as Venturi scrubbers, can also be compressors, or pumps, which have a sufficient amount of operating liquid, such as roots blowers with injection, screw compressors, fluid-ring pumps or fluid-jet pumps. By combining the process with a polytropic compression system, the temperatures of certain mixtures can be adjusted as required, for example, by extracting waste heat from an expansion process by volumetric feeding of the gas of the heat power provided, without having to generate an excess pressure on the evaporator side.

The method according to the present invention for converting heat energy from fluids into mechanical energy can be used for widely varying fluids which are either present as one-component fluids or as fluid mixtures. The fluids can also be either gaseous or liquid. With gaseous fluids the presence of condensable components, which condense in the evaporation according to the present invention of a "first" working fluid by lowering the temperature below the dew-point, is particularly advantageous since the condensation heat set free thereby, which is present as latent heat, substantially increases the usable potential energy because the latent heat energies are usually substantially higher with phase transitions of condensable gases than the perceivable heat energies with permanent gases, wherein advantageously the phase transition occurs while the temperature remains constant.

Examples for such fluids could be exhaust air or waste water flows from industrial cooling, heat exchange or expansion processes.

A particularly preferred embodiment of the present invention relates to the conversion of heat energy from atmospheric air with water vapor present therein in the form of air moisture.

From an energetic point of view atmospheric air with water vapor present therein is an enormous, practically inexhaustible energy reservoir. Most importantly, taking current meteorological data into account, this energy reservoir formed by the perceivable heat of the air and the latent heat of the water vapor is available everywhere on the earth, i.e. independent of the global position. This energy reservoir is constantly replenished by solar radiation. This is why basically the conversion of the heat energy contained in moist air to mechanical energy is an indirect utilization of the heat energy from solar radiation.

The critical advantage of air with water vapor present therein as air moisture as an energy store for solar radiation lies in its fluid character, so that due to natural or generated flow it can be passed in great volumes through heat exchange apparatuses, so that the amount of heat energy usable by apparatuses can be uncoupled in time and space from the limited radiation power of the sun. This is why this energy reservoir which is inexhaustible and globally available can be technically utilized at any time and in any place.

With reference to the above explanations a particularly preferred embodiment of the method of the present invention provides that the heat energy from moist ambient air is taken up in an evaporator for evaporating a suitable working fluid and to expand the vapor by means of a low-pressure expansion device according to the above explanations, if necessary after a transformation to a higher temperature level with one or more heat pumps depending on the actual environmental conditions with respect to temperature and moisture, wherein heat energy is partially converted into mechanical energy and the energy remaining in the expanded working fluid is recyclable. Herein on the one hand the gaseous components are cooled, on the other the air moisture content is largely condensed depending on the temperature levels of the heat exchange processes, wherein the high condensation heat of the water is gained for the process.

With sufficiently high environmental temperatures and air moistures and with the use of isotropic mixtures with sufficiently low boiling points as working fluids, the conversion can also be advantageously realized without the interposition of a heat pump.

The mean coefficient of performance of the system according to the present invention for converting heat energy of fluids into mechanical energy at a starting fluid temperature of 25° C., measured over 24 hours, is between 2.5 and 12. The mean coefficient of performance can be between 3 and 10 or 4 and 8 for systems according to the present invention. Preferably the mean coefficient of performance is between 5 and 6 for systems of the present invention.

Coefficients of performance of above 4 can be achieved, for example, by using absorption heat pumps and/or heat pumps with liquid sealed compressor systems, as they are described, for example, in PCT/EP2004/053651, which is incorporated in its entirety by reference.

The overall efficiency of the system according to the present invention for converting heat energy of fluids into mechanical energy at a starting fluid temperature of 25° C., measured over 24 hours, is preferably at more than 40%, preferably at more than 50%, and particularly preferably at more than 60%.

For example between 15% and 40%, preferably between 20% and 35%, and preferably between 25% and 30% of the energy set free by expanding the working fluid in the low-pressure expansion device can be used for transformation into mechanical energy.

When energy is extracted from the air, systems according to the present invention can extract energy from air volumes of between 1.6 $m^3$/h and 160,000 $m^3$/h. Of course energy can also be extracted from air volumes much larger than this. It has been found, however, that for a household a dimensioning in the range of 160 $m^3$/h and 1600 $m^3$/h is economical.

From air volumes of between 16 $m^3$/h to 160,000 $m^3$/h at 25° C., 0.1 kW to 1000 kW of electric energy can be generated, for example, with systems according to the present invention.

1 kW of electric energy can be generated, for example, with systems according to the present invention from air volumes of 160 $m^3$/h at 25° C., and 10 kW of electric energy can be generated, for example, from air volumes of 1600 $m^3$/h at 25° C.

The systems of the present invention can also extract energy from all kinds of gases and/or liquids, as long as they do not damage the system. Gases for energy generation can be used from a temperature of at least 15° C. up to 250° C. or even 350° C. or more. Gases at high temperatures are usually produced as process gases. Temperatures of 300° C. or above are generated with operating fluids such as oils or the like.

However, according to the present invention it is preferred to use the heat energy from ambient air, which is usually at between 15° C. and 50° C., preferably at between 20° C. and 40° C., and preferably at between 25° C. and 35° C.

With systems according to the present invention it may be advantageous if the temperature T1 of the working fluid upstream of the low-pressure expansion device is higher than the temperature T2 of the working fluid downstream of the low-pressure expansion device and upstream of the absorption device. In contrast, the temperature T3 of the working fluid in the evaporation unit is higher than the temperature T2 of the working fluid downstream of the low-pressure expansion device and upstream of the absorption device.

The temperature of the working fluid in the evaporator can be between 10° C. and 250° C., preferably between 20° C. and 200° C., preferably between 30° C. and 150° C., more preferably between 40° C. and 130° C., and particularly preferably between 50° C. and 100° C. Most preferably the temperature of the working fluid in the evaporator is above the boiling point.

The pressure of the working fluid upstream of the low-pressure expansion device can be in the range of between 0.3 bar and 15 bar. Higher pressures are possible which, however, lead to higher material cost in these systems so that the working fluid in the conduit from the evaporator to the low-pressure expansion device is preferably in the range of between 1 bar and 10 bar, more preferably in the range of between 1.5 bar and 8 bar, more preferably in the range of between 2 bar and 6 bar, and more preferably in the range of between 3 bar and 4 bar.

The pressure difference $\Delta P$ of the working fluid upstream of the low-pressure expansion device and directly downstream of the expansion of the working fluid but upstream of the absorption device should be between $\Delta P$ 0.1 bar and 5 bar, preferably between $\Delta P$ 0.5 bar and 3 bar, and more preferably between $\Delta P$ 0.75 bar and 1 bar.

BRIEF DESCRIPTION OF THE DRAWINGS

Further advantages, features and details of the present invention can be derived from the following description which describes with reference to FIG. 1 an embodiment of the present invention in detail. The features indicated in the claims and the description can be essential for the present invention singly or in any combination.

DETAILED DESCRIPTION OF THE PREFERRED EMBODIMENTS

Figure 1:
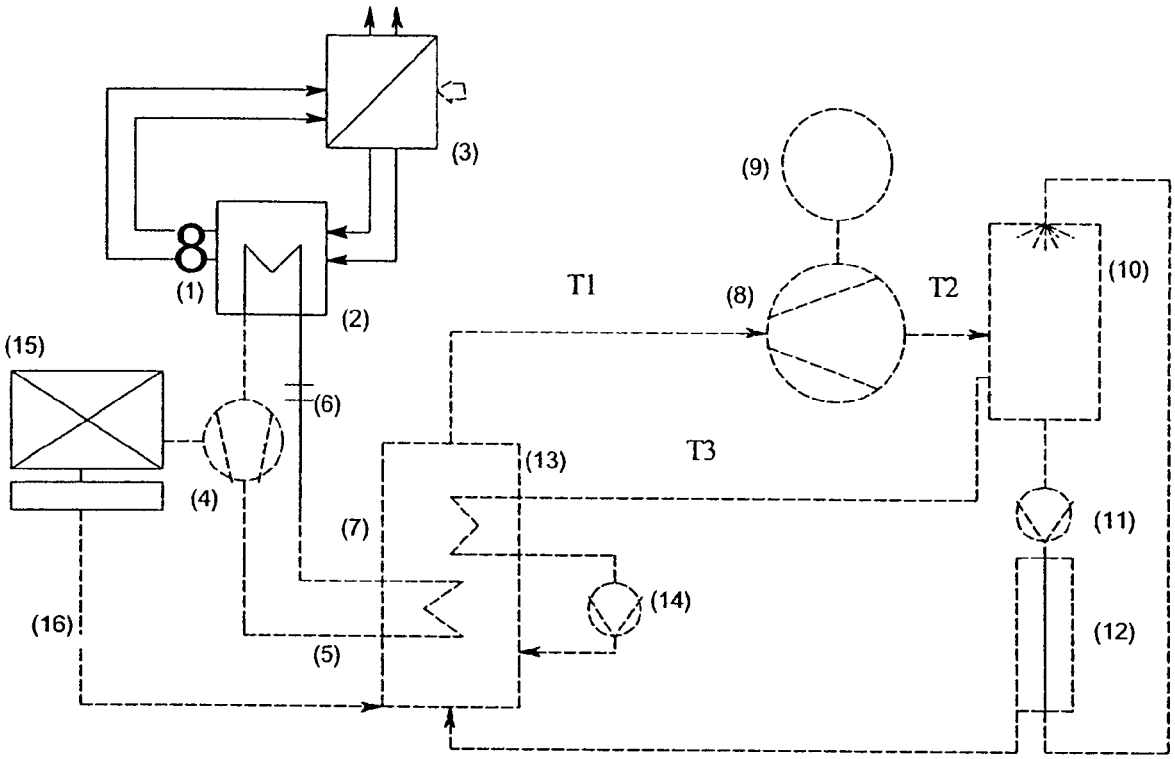
FIG. 1 shows a system for converting heat energy from moist ambient air into mechanical energy.

The present is based on an embodiment with an upstream mechanically driven heat pump and a low-pressure expansion device with an isotropic mixture as the working fluid.

With the aid of a fan 1, a force-fed air flow is cooled in a heat exchanger 2. In order to improve the efficiency of the process the air input into an air-air heat exchanger 3 can be pre-cooled by means of heat exchange with the cooled air.

Heat exchanger 2 serves as an evaporation unit of a heat pump which comprises, as further functional components, compressor 4, heat exchange unit 5, which functions as a condensator, and expansion valve 6.

The heat pump serves to transform the energy extracted in evaporator 2 from the condensation of the air moisture, in addition to cooling the air, to a higher temperature level and gives off the heat at this high temperature level in heat exchange unit 5 by means of condensation. The energy set free is used for evaporating an isotropic mixture which is used as the working fluid of an energy cycle process. The vapors generated from the isotropic mixture in evaporating unit 7 are expanded by a low-pressure expansion device 8, whereby a mechanical force is applied to the shaft which can be transformed to electric current with the aid of generator 9.

The expanded vapors are separated in a downstream scrubber 10 in which the absorption fluid injected into the top of scrubber 10 absorbs one of the components. The absorption heat set free in this way is transferred to the other component remaining evaporated, whereby the remaining vapors are heated to a temperature level above the boiling point of the isotropic mixture. The remaining vapors give off their condensation heat in heat exchanger unit 13, which is integrated in evaporating unit 7. The component condensated in 13 is fed with the aid of pump 14 back into the reservoir for the isotropic mixture and is available again for being mixed with the other component.

The component absorbed in the scrubber is fed to a membrane filter 12 with the aid of pump 11, where this component is separated again from the absorption fluid. The pressure generated by pump 11 is sufficient on the one hand to feed the absorption fluid back to the scrubber and on the other hand to feed the second component to evaporation unit 7. Herein, the two components are mixed with each other again in the storage volume of the evaporating unit.

For generating the driving vapor from the isotropic mixture, two energy portions are therefore involved: on the one hand the energy extracted with the aid of heat pump 2, 4, 6, 5 from the cooled air and the condensed air moisture and transformed to the high temperature level for evaporation, and on the other hand the absorption energy from the drive vapor separation of the vapors formed of an isotropic mixture fed in in the energy cycle process downstream of the expansion. This recycling of the energy according to the present invention ensures the high efficiency of the power generation from air.

For driving compressor 4 of the heat pump in an advantageous embodiment an engine 15 could also be used which would be operated with Diesel or natural gas or with biogenous fuels, such as biogas, colza oil or biodiesel and the like. In this variant, an additional energy proportion can be used for evaporating unit 7 from the engine's waste heat or from the exhaust gases' waste heat of engine 15 which is fed to the evaporator 7 by a conduit 16. With such an arrangement, on the one hand the efficiency of the overall process is further improved and on the other hand the startup of the system is facilitated.

What is claimed is:

1. A method of converting heat energy from a fluid into mechanical energy, comprising the steps of:

evaporating a working fluid by heat exchange in an evaporator, the working fluid comprising a mixture of at least two components;

expanding the evaporated working fluid in a low-pressure expansion device;

partially converting energy of the working fluid set free in said step of expanding to mechanical energy;

withdrawing energy from at least a first component of the working fluid and raising a temperature of at least a second component of the working fluid downstream of the low-pressure expansion device, the energy held in the at least a second component of the working fluid after said step of raising the temperature being recyclable into the evaporator and usable for evaporating additional working fluid; and absorbing, by an absorption fluid, the first component of the working fluid by an absorption device arranged downstream of the low-pressure expansion device.

2. The method of claim 1, wherein said step of withdrawing energy from at least a first component comprises setting energy free in at least one of an absorption and an adsorption process, and at least part of the energy required for said step of raising the temperature of the at least a second component after low-pressure expansion is gained from the energy set free in the one of the absorption and adsorption process.

3. The method of claim 1, wherein the first component is absorbed one of in and downstream of the low-pressure expansion device by an absorption fluid, and wherein heat is transferred to the second component that remains evaporated, the transferred heat being recyclable.

4. The method of claim 1, wherein the mixture is isotropic at a certain mixing ratio and has a minimum boiling point.

5. The method of claim 1, wherein the working fluid is present as an isotropic mixture or as a mixture with a lowered boiling point with respect to the boiling point of the component of the mixture having the highest boiling point, wherein a difference between the lowered boiling point and the highest boiling point is at least 5° C.

6. The method of claim 2, wherein said step setting energy free in at least one of an absorption and an adsorption process comprises controlling absorption of the first component such that the second component that remains evaporated is heated to a temperature above the boiling point of the mixture, said method further comprising the step of condensing the second component in the heat exchanger in which the evaporation of the working fluid occurs.

7. The method of claim 1, wherein the working fluid is a solvent mixture with a low molar evaporation enthalpy and has at least one of organic and inorganic solvent components, wherein one of the components of the working fluid is a protic solvent.

8. The method of claim 3, wherein the absorption fluid is a reversibly immobilizable solvent, and wherein the absorption fluid in its non-immobilized aggregate state is the first component of the working fluid.

9. The method of claim 1, wherein the working fluid is a mixture of water and silicone.

10. The method of claim 1, wherein the working fluid is a silicate solution.

11. The method of claim 1, wherein the low-pressure expansion device is a roots blower.

12. The method of claim 11, wherein the roots blower is configured with at least one injection opening, said method comprising the step of introducing an absorption fluid or a protic solvent into the roots blower through the at least one injection opening.

13. The method of claim 1, further comprising the step of separating the absorbed first component from the absorption fluid in a separating device.

14. The method of claim 13, wherein the separating device is configured as a membrane system.

15. The method of claim 13, wherein the separating device is a generator unit in which the absorbed first component is desorbed by heating.

16. The method of claim 13, further comprising the steps of feeding the absorption fluid to the separating device and subsequently back to the absorption device using a pump.

17. The method of claim 1, wherein the step of raising a temperature of at least a second component is performed using a heat pump driven by a mechanical evaporator or by a liquid sealed compressor system.

18. The method according to claim 17, wherein the heat pump is formed as an absorption heat pump with an isotropic mixture, the temperature increase being effected by absorbing one component and transferring the absorption energy to the second component remaining evaporated.

19. The method of claim 1, wherein the working fluid has at least one component and is a gas or fluid.

20. The method of claim 19, wherein the working fluid is a gas or liquid flow from industrial cooling, heat exchange, transformation or expansion processes.

21. The method of claim 19, wherein the working fluid is atmospheric ambient air with water vapor contained in it as air moisture.

22. The method of claim 1, the heat energy is one of noticeable and latent heat of individual or plural components.

23. The method of claim 1, wherein said step of evaporating comprises transforming heat energy to a higher temperature using at least one heat pump to evaporate the working fluid in the evaporator.

24. The method of claim 1, further comprising the step of processing condensate water produced by the at least one heat pump to produce one of industrial water and drinking water.

25. The method of claim 1, wherein the absorption device is configured as a scrubber.

26. A method of converting heat energy from a fluid into mechanical energy, comprising the steps of:

evaporating a working fluid by heat exchange in an evaporator, the working fluid comprising a mixture of at least two components;

expanding the evaporated working fluid in a low-pressure expansion device;

partially converting energy of the working fluid set free in said step of expanding to mechanical energy; and withdrawing energy from at least a first component of the working fluid and raising a temperature of at least a second component of the working fluid downstream of the low-pressure expansion device, the energy held in the at least a second component of the working fluid after said step of raising the temperature being recyclable into the evaporator and usable for evaporating additional working fluid, wherein the first component is absorbed one of in and downstream of the low-pressure expansion device by an absorption fluid, and wherein heat is transferred to the second component that remains evaporated, the transferred heat being recyclable.

27. A method of converting heat energy from a fluid into mechanical energy, comprising the steps of:

evaporating a working fluid by heat exchange in an evaporator, the working fluid comprising a mixture of at least two components;

expanding the evaporated working fluid in a low-pressure expansion device;

partially converting energy of the working fluid set free in said step of expanding to mechanical energy; and withdrawing energy from at least a first component of the working fluid and raising a temperature of at least a second component of the working fluid downstream of the low-pressure expansion device, the energy held in the at least a second component of the working fluid after said step of raising the temperature being recyclable into the evaporator and usable for evaporating additional working fluid, wherein said step of withdrawing energy from at least a first component comprises setting energy free in at least one of an absorption and an adsorption process, and at least part of the energy required for said step of raising the temperature of the at least a second component after low-pressure expansion is gained from the energy set free in the one of the absorption and adsorption process, and wherein said step setting energy free in at least one of an absorption and an adsorption process comprises controlling absorption of the first component such that the second component that remains evaporated is heated to a temperature above the boiling point of the mixture, said method further comprising the step of condensing the second component in the heat exchanger in which the evaporation of the working fluid occurs.

28. A method of converting heat energy from a fluid into mechanical energy, comprising the steps of:

evaporating a working fluid by heat exchange in an evaporator, the working fluid comprising a mixture of at least two components;

expanding the evaporated working fluid in a low-pressure expansion device;

partially converting energy of the working fluid set free in said step of expanding to mechanical energy; and withdrawing energy from at least a first component of the working fluid and raising a temperature of at least a second component of the working fluid downstream of the low-pressure expansion device, the energy held in the at least a second component of the working fluid after said step of raising the temperature being recyclable into the evaporator and usable for evaporating additional working fluid, wherein the step of raising a temperature of at least a second component is performed using a heat pump driven by a mechanical evaporator or by a liquid sealed compressor system, and wherein the heat pump is formed as an absorption heat pump with an azeotropic mixture, the temperature increase being effected by absorbing one component and transferring the absorption energy to the second component remaining evaporated.

* * * * *